US005284496A

United States Patent [19]

Baillargeon et al.

[11] Patent Number: 5,284,496

[45] Date of Patent: * Feb. 8, 1994

[54] OLIGOMERIC/POLYMERIC MULTIFUNCTIONAL ADDITIVES TO IMPROVE THE LOW-TEMPERATURE PROPERTIES OF DISTILLATE FUELS

[75] Inventors: David J. Baillargeon, Cherry Hill; Angeline B. Cardis, Florence; Dale B. Heck, West Deptford, all of N.J.; Susan W. Johnson, Centreville, Va.

[73] Assignee: Mobil Oil Corporation, Fairfax, Va.

[ * ] Notice: The portion of the term of this patent subsequent to Nov. 30, 2010 has been disclaimed.

[21] Appl. No.: 946,218

[22] Filed: Sep. 17, 1992

[51] Int. Cl.[5] ..... C10L 1/18

[52] U.S. Cl. ..... 44/393; 44/386

[58] Field of Search ..... 44/393, 386

[56] References Cited

U.S. PATENT DOCUMENTS 5,112,937 5/1992 Garapon et al. ..... 44/386

5,156,655 10/1992 Baillargeon et al. ..... 44/386

*Primary Examiner*—Ellen M. McAvoy

*Attorney, Agent, or Firm*—Alexander J. McKillop; Malcolm D. Keen; Howard M. Flournoy

[57] ABSTRACT

Additives which improve the low-temperature properties of distillate fuels are oligomeric/polymeric reaction products of anhydrides and long-chain epoxides (or their corresponding acid/diol equivalents) consisting of hydroxyl promoted polyesters and ester promoted polyesters.

23 Claims, No Drawings

OLIGOMERIC/POLYMERIC MULTIFUNCTIONAL ADDITIVES TO IMPROVE THE LOW-TEMPERATURE PROPERTIES OF DISTILLATE FUELS

BACKGROUND OF THE INVENTION

Field of the Invention

This application is directed to oligomeric/polymeric multifunctional additives comprised of hydroxyl promoted ester materials, and ester promoted polyester materials useful for improving the low-temperature properties of distillate fuels and to fuel compositions containing same.

Description of Related Art

Traditionally, the low-temperature properties of distillate fuels have been improved by the addition of kerosene, sometimes in very large amounts (5–70 wt %). The kerosene dilutes the wax in the fuel, i.e., lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity; however, most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

BRIEF SUMMARY OF THE INVENTION

Novel polyester and modified polyester polymers have been prepared from (1) anhydrides or acid equivalents, long-chain epoxides or diol equivalents and epoxidized fatty esters, and (2) from anhydrides, long-chain epoxides and co-reacted polyalcohols and have been found to be surprisingly active wax crystal modifier additives for distillate fuels. Distillate fuel compositions containing $\leqq 0.1$ wt % of such additives demonstrate significantly improved low-temperature flow properties, i.e., lower cloud point and lower CFPP filterability temperature. In addition, additives from (1) and (2) above in combination with a pour point additive achieve additional performance improvements, especially in lowering cloud point of the treated fuel.

These additives are oligomeric and/or polymeric ester products which have linear hydrocarbyl pendant groups attached to the backbone of the oligomeric/-polymeric structure. These esters are derived from the polymerization of a suitable combination of monomers which include (1) one or more epoxides, (2) one or more anhydrides, and (3) a reactive material, e.g., epoxidized fatty ester, isocyanates, epoxy halides, diepoxides, carbamates, dianhydrides or polyols, etc., which may function as a chain transfer agent, chain terminator, chain propagator, or chain cross-linking agent. Alternatively, condensation reaction with removal of water or other such by-product may be employed to make the same oligomeric/polymeric esters from a monomer mixture which may include (1) one or more long-chain diols, (2) one or more diacid equivalents (anhydride, diacid, diacid chloride, etc.), and (3) the same reactive materials listed above.

Additionally, the oligomeric and/or polymeric ester products, derived as described above, may be further reacted with additional reagents in a second synthetic step so as to derivatize, cap, or otherwise modify reactive end groups or other pendant groups incorporated along the backbone of the original oligomeric/polymeric ester. These additional reagents may include, for example, amines or alcohols which would serve to convert residual acids and anhydrides in the oligomeric/-polymeric ester product to alternate carboxyl derivatives such as amides, imides, salts, esters, etc. Similarly, residual epoxides would be converted to amine and ether adducts. These examples serve to illustrate, but not limit, the concept of post-reacting the original oligomeric/polymeric ester product to modify its original chemical functionality.

These oligomeric/polymeric esters are structurally very different from the known categories of polymeric wax crystal modifiers. Known polymeric wax crystal modifiers are generally radical-chain reaction products of olefin monomers, with the resulting polymer having an all-carbon backbone. The materials of this invention are condensation products of epoxides (or diols) and anhydrides (or acid equivalents) to give polymeric structures where ester functions are regularly spaced along the polymer backbone.

These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The compositions of these additives are unique. Also, the additive concentrates and fuel compositions containing such additives are unique. Similarly, the processes for making these additives, additive concentrates, and fuel compositions are unique.

The primary object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

DESCRIPTION OF THE PREFERRED EMBODIMENTS

The additives of this invention have comb-like structures, where a critical number of linear hydrocarbyl groups are attached to the backbone of an oligomeric/-polymeric polyester. These additives are reaction products obtained by combining two, or optionally more, monomers in differing ratios using standard techniques for condensation polymerization. These wax crystal modifiers which are effective in lowering cloud point are generally characterized as alternating co-oligomers/copolymers (or optionally terpolymers, etc.) of the following type:

(—A—B)n;

(—A—A'—B)n;

(—A—B—B')n; or (—A—B—C—)n where n≧1, A or A' is one or more anhydrides or diacid equivalents, B or B' is one or more epoxides or diols and C is said reactive material. One combination of monomers may include (A) one or more anhydrides, (B) one or more long-chain epoxides, and (C) a reactive material, e.g., isocyanates, epoxy halides, diepoxides, carbamates, dianhydrides or polyols, etc., which may function as a chain transfer agent, chain terminator, chain propagator, or chain cross-linking agent. Alternatively, a second combination of monomers, in which the removal of a low molecular weight by-product accompanies the condensation reaction, may include (A) one or more diacid equivalents (anhydride, diacid, diacid chloride, etc.), (B) one or more diols, and (C) the same reactive materials listed above. Comonomer stoichiometry may vary widely with A:B=1:2 to 2:1, or preferably A:B=1:1.5 to 1.5:1, or most preferably A:B=1:1.1 to 1.1:1. Termonomers, component C, may substitute for some fraction of A or B in the above stoichiometric ranges.

The pendant linear hydrocarbyl groups are carried by at least one, and optionally by more than one, of the monomers. These critical linear pendant hydrocarbyl groups are generally $C_{12}$ or longer.

Additives of this invention may be grouped into categories based on distinct structural and compositional differences, described below. Preparation of selected additives are given in EXAMPLES 1-2. Additive compositions and their respective performance for cloud point and CFPP are given in TABLES 1-2.

Category A: Hydroxyl-Promoted Ester Compositions (TABLE 1)

Successful wax crystal modifier additives may be obtained as mixtures of (1) ABC-type oligomers/polymers which can be prepared from an anhydride (A monomer), a long-chain epoxide (B monomer), and a co-reacted polyalcohol (C monomer) using an amine catalyst, and additionally (2) a common pour point reducing additive, for example, ECA 12513. "ECA" is used to signify an ethylene polymer containing carboxylic acid groups along the polymer chain. This includes polymers wherein there can be a minor amount of one or more other copolymerizable unsaturated monomers. The polyalcohol renders the oligomer/polymer composition susceptible to a significant and beneficial synergistic interaction with the pour point additive to improve diesel fuel cloud point. The impact of adding pour point additive, e.g., ECA 12513, to the hydroxyl-promoted oligomeric/polymeric ester composition is evident in Table 1 where the improvements in diesel fuel cloud point are shown. The polyalcohols used in this invention may include polyols (Entries 124–127) as well as aminopolyols (Entries 128–135). The pour point additives which may be used in this invention include any of the polyolefin type polymers in which pendant linear hydrocarbyl groups are attached directly to the polymer backbone, and/or attached via ester, amide, ammonium salts, or other functional groups to the polymer backbone. The specific pour point additive used in these examples is ECA 12513.

Preparation of a typical additive composition, including the synthesis of a dipentaerythritol-promoted phthalate oligomer/polymer (Entry 125), is given in EXAMPLE 1.

Category B: Ester-Promoted Polyester Compositions (TABLE 2)

Successful wax crystal modifier additives may be obtained as mixtures of (1) ABC-type oligomers/polymers which can be prepared from an anhydride (A monomer), a long-chain epoxide (B monomer), and an epoxidized fatty ester (C monomer) using an amine catalyst, and additionally (2) a common pour point reducing additive, for example, ECA 12513. When incorporated into the reaction product of (1), the epoxidized fatty ester provides ester functional groups which are pendant from the oligomer/polymer backbone. More importantly, the epoxidized fatty ester renders the final oligomer/polymer susceptible to a significant additional and beneficial synergistic interaction with a pour point additive to improve diesel fuel cloud point. Any of the anhydride/epoxide compositions described previously are suited to this additional modification. The impact of adding pour point additive, e.g., ECA 12513, to the ester-promoted oligomeric/ polymeric ester composition is evident in Table 2 where the improvements in diesel fuel cloud point are shown. Various epoxidized fatty esters were selected in making the modified oligomers/polymers described above (Entries 136–141), and they may be used in concentrations of 0.001 wt % or higher. The pour point additives which may be used in this invention include any of the polyolefin type polymers in which pendant linear hydrocarbyl groups are attached directly to the polymer backbone, and/or attached via ester, amide, ammonium salts, or other functional groups to the polymer backbone. The specific pour point additive used in these examples is ECA 12513.

Preparation of a typical additive composition, including the synthesis of an epoxidized fatty ester-promoted phthalate oligomer/polymer (Entry 136, Table 2), is given in EXAMPLE 2.

Generally speaking, the reactions can be carried out under widely varying conditions which are not believed to be critical. The reaction temperatures can vary from about 50° to 250° C., under ambient or autogenous pressure. However, slightly higher pressures up to about 100 psi may be used if desired. The temperatures chosen will depend upon for the most part on the particular reactants and on whether or not a solvent is used. Reactants may be run with or without solvents. Solvents, if used, will typically be hydrocarbon solvents such as xylene, but any non-polar, unreactive solvent can be used including benzene and toluene and/or mixtures thereof. Molar ratios, less than molar ratios or more than molar ratios of the reactants can be used.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T. Typical jet fuels are defined in Military Specification MIL-F-5624B.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

The following examples are illustrative only and are not intended to limit the scope of the invention.

EXAMPLE 1

Preparation of Additive Entry 125 (Table 1)

Phthalic anhydride (29.6 g, 0.20 mol; e.g., from Aldrich Chemical Co.), dipentaerythritol (5.09 g, 0.020 mol; e.g., from Aldrich Chemical Co.), 1,2-epoxyoctadecane (57.0 g, 0.20 mol; e.g., Vikolox 18 from Viking Chemical), triethylamine (0.41 g, 0.004 mol; e.g., from Aldrich Chemical Co.), and 4-dimethylaminopyridine (0.12 g, 0.001 mol; e.g., DMAP from Nepera, Inc.) were combined and heated at 120°-200° C. for 5 hours. The reaction mixture was then hot filtered through a mixed bed of alumina (approximately 20%) and Celite to give 75.6 g of the final product.

EXAMPLE 2

Preparation of Additive Entry 136 (Table 2)

Phthalic anhydride (31.2 g, 0.21 mol; e.g., from Aldrich Chemical Co.), epoxidized methyl soyate (2.54 g, 0.010 mol; e.g., Vikoflex 7010 from Viking Chemical), 1,2-epoxyoctadecane (57.0 g, 0 20 mol; e.g., Vikolox 18 from Viking Chemical), triethylamine (0.43 g, 0.004 mol; e.g., from Aldrich Chemical Co.), and 4-dimethylaminopyridine (0.13 g, 0.001 mol; e.g., DMAP from Nepera, Inc.) were combined and heated at 110° C./5 hours and 140° C./1 hour. The reaction mixture was then hot filtered through a mixed bed of alumina (approximately 20%) and Celite to give 79.0 g of the final product.

PREPARATION OF ADDITIVE CONCENTRATE

A concentrate solution of 100 ml total volume was prepared by dissolving 10 g of additive in mixed xylenes solvent. Any insoluble particulates in the additive concentrate were removed by filtration before use. Any suitable hydrocarbon solvent such as xylene, mixed xylenes or toluene can be used.

TEST FUELS

The following test fuel was used for the screening of additive activity:

| | | |
|---|---|---|
| API Gravity | 31.5 | |
| Cloud Point (°F.) | 21.4 | |
| CFPP (°F.) | 14 | |
| Pour Point (°F.) | 10 | |
| Distillation (°F.; D 86) | IBP | 340 |
| | 10% | 439 |
| | 50% | 534 |
| | 90% | 640 |
| | FBP | 693 |

TEST PROCEDURES

The cloud point of the additized distillate fuel was determined using an automatic cloud point test based on the commercially available Herzog cloud point tester; test cooling rate is approximately 1° C./minute. Results of this test protocol correlate well with ASTM D2500 methods. The test designation (below) is "HERZOG".

The low-temperature filterability was determined using the Cold Filter Plugging Point (CFPP) test. This test procedure is described in "Journal of the Institute of Petroleum", Volume 52, Number 510, June 1966, pp. 173-185.

Test results are recorded in Tables 1-2.

The products of this invention represent a significant new generation of wax crystal modifier additives which are dramatically more effective than may previously known additives. They represent a viable alternative to the use of kerosene in improving diesel fuel low-temperature performance.

TABLE 1

HYDROXYL-PROMOTED POLYESTER/POUR POINT (ECA 12513) ADDITIVES. CATEGORY A: CO-REACTED EPOXIDE/POLYOL/ANHYDRIDE COMPOSITIONS.

| ENTRY | EPOXIDE | POLYOL | ANHYDRIDE | MOLE RATIO | PERFORMANCE IMPROVEMENT (F): "POLYESTER" CLOUD POINT (HERZOG) | "POLYESTER" CLOUD POINT CFPP | "POLYESTER/PP ADDITIVE" CLOUD POINT (HERZOG) | "POLYESTER/PP ADDITIVE" CLOUD POINT CFPP |
|---|---|---|---|---|---|---|---|---|
| FUEL B; 500 ppm ADDITIVE; 200 ppm ECA 12513 | | | | | | | | |
| 124 | VIKOLOX 18 | DIPENTAERY-THRITOL | PHTHALIC ANHY | 1/0.02/1 | 3.4 | 4 | 5.2 | 2 |
| 125 | VIKOLOX 18 | DIPENTAERY-THRITOL | PHTHALIC ANHY | 1/0.1/1 | 3 | 2 | 5 | 6 |
| 126 | VIKOLOX 18 | PENTAERY-THRITOL | PHTHALIC ANHY | 1/0.02/1 | 3 | 4 | 5.4 | 4 |
| 127 | VIKOLOX 18 | PENTAERY-THRITOL | PHTHALIC ANHY | 1/0.1/1 | 2.8 | 4 | 4.8 | 4 |
| 128 | VIKOLOX 18 | QUADROL | PHTHALIC ANHY | 1/0.02/1 | 3.8 | 2 | 4.1 | 4 |
| 129 | VIKOLOX 18 | QUADROL | PHTHALIC ANHY | 1/0.1/1 | 3.2 | 2 | 3.6 | 2 |
| 130 | VIKOLOX 18 | TRIETHANOL-AMINE | PHTHALIC ANHY | 1/0.02/1 | 4.1 | 4 | 4.5 | 2 |
| 131 | VIKOLOX 18 | TRIETHANOL-AMINE | PHTHALIC ANHY | 1/0.1/1 | 3.1 | 4 | 3.8 | 4 |
| 132 | VIKOLOX 18 | TRIS AMINO | PHTHALIC ANHY | 1/0.02/1 | 4.4 | 2 | 4.7 | 4 |
| 133 | VIKOLOX 18 | TRIS AMINO | PHTHALIC ANHY | 1/0.1/1 | 3.5 | 2 | 4 | 4 |
| 134 | VIKOLOX 18 | 2-AMINO-2-ETHYL-1,3-PROPANEDIOL | PHTHALIC ANHY | 1/0.02/1 | 4.2 | 4 | 4.5 | 2 |
| 135 | VIKOLOX 18 | 2-AMINO-2-ETHYL-1,3-PROPANEDIOL | PHTHALIC ANHY | 1/0.05/1 | 3.6 | 2 | 4.2 | 4 |

TABLE 2

ESTER-PROMOTED POLYESTER/POUR POINT (ECA 12513) ADDITIVES. CATEGORY B: ESTER-MODIFIED POLYESTERS.

| ENTRY | EPOXIDE | EPOXIDIZED ESTER | ANHYDRIDE | MOLE RATIO | PERFORMANCE IMPROVEMENT (F): "POLYESTER" CLOUD POINT (HERZOG) | "POLYESTER" CLOUD POINT CFPP | "POLYESTER/PP ADDITIVE" CLOUD POINT (HERZOG) | "POLYESTER/PP ADDITIVE" CLOUD POINT CFPP |
|---|---|---|---|---|---|---|---|---|
| FUEL B; 500 ppm ADDITIVE; 200 ppm ECA 12513 | | | | | | | | |
| 136 | VIKOLOX 18 | VIKOFLEX 7010 | PHTHALIC ANHY | 0.95/0.05/1 | 2.3 | 0 | 4.5 | 4 |
| 137 | VIKOLOX 18 | VIKOFLEX 7010 | PHTHALIC ANHY | 0.9/0.1/1 | 2.4 | 4 | 3.6 | 4 |
| 138 | VIKOLOX 18 | VIKOFLEX 7010 | PHTHALIC ANHY | 0.85/0.15/1 | 2.2 | 0 | 3.8 | 4 |
| 139 | VIKOLOX 18 | VIKOFLEX 5075 | PHTHALIC ANHY | 1/0.02/1 | 3.3 | 2 | 4.3 | 6 |
| 140 | VIKOLOX 18 | VIKOFLEX 9010 | PHTHALIC ANHY | 1/0.02/1 | 3.5 | 0 | 4.1 | 4 |
| 141 | VIKOLOX 18 | VIKOFLEX 9010 | PHTHALIC ANHY | 0.9/0.05/1 | 2.7 | 2 | 3.4 | 2 |

APPENDIX 1. GLOSSARY

| | |
|---|---|
| CFPP: | cold filter plugging point |
| DMAP: | 4-dimethylamino-pyridine |
| Herzog: | cloud point test; Herzog method |
| Phthalic anhydride: | 1,2-benzenedicarboxylic anhydride |
| Quadrol: | tetrahydroxypropyl ethylenediamine |
| Vikoflex 7010: | epoxidized methyl soyate |
| Vikoflex 9010: | epoxidized methyl linseedate |
| Vikolox "N": | Linear 1,2-epoxyalkane, where N = the carbon number of the alkyl chain; N = 12, 14, 16, 18, 20, 20–24, 24–28, 30+. |

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. A multifunctional low-temperature-modifying distillate fuel additive comprised of a polymeric and/or oligomeric ester additive product of reaction consisting of hydroxyl promoted polyester materials and ester promoted polyester materials prepared by poylymerizing or oligomerizing a suitable combination of monomers selected from the group consisting of (1) one or more long-chain epoxides or diol equivalents, (2) one or more anhydrides or acid equivalents, and either (a) one or more epoxidized fatty esters or (b) one or more polyalcohols, and optionally (3) a suitable reactive material under suitable conditions of time, temperature and pressure comprising molar ratios varying from equimolar to more than molar to less than molar, at temperatures varying from about 50° to about 250° C., pressures varying from atmospheric to about 100 psi, for times varying from about an hour to about 48 hours thereby producing the desired ester additive product said product containing polymeric structures having ester functions and long-chain hydrocarbyl groups independently and regularly spaced along the polymer backbone.

2. The additive product of claim 1 wherein said reaction material is selected from the group consisting of epoxidized fatty esters, isocyanates, diisocyanates, epoxy halides, carbamates, diepoxides or dianhydrides.

3. The additive product of claim 1 wherein at least one of said monomers and optionally more than one, has a pendant hydrocarbyl group of at least $C_{12}$ or longer and wherein hydrocarbyl is selected from the group consisting of alkyl, alkenyl, aryl, alkaryl, aralkyl and optionally may be cyclic or polycyclic.

4. The additive product of claim 1 wherein the product is post reacted with amines, alcohols or mixtures of amines and alcohols.

5. The product of claim 1 wherein the monomers are phthalic anhydride, dipentaerythritol and 1,2-epoxyoctadecane.

6. The product of claim 1 wherein the monomers are phthalic anhydride, epoxidized methyl soyate and 1-2-epoxyoctadecane.

7. The additive reaction products of claim 1 prepared from monomers and/or reactive materials wherein said monomers or reactive materials are selected from the group consisting of 1,2-epoxyoctadecane, dipentaerythritol, pentaerythritol, tetrahydroxpropyl ethylenediamine, triethanolamine, 2-amino-2-ethyl-1,3-propanediol, epoxidized methyl soyate, epoxidized methyl linsedate, and phthalic anhydride.

8. A process of preparing a multifunctional low-temperature modifying distillate fuel polymeric and/or oligomeric ester product of reaction comprised of hydroxyl promoted polyester materials and ester promoted polyester materials comprising polymerizing or oligomerizing a suitable combination of monomers selected from the group consisting of one or more long-chain epoxides or diol equivalents, one or more anhydrides or acid equivalents, and either (1) one or more epoxidized fatty esters, or (2) one or more polyalcohols, and optionally a suitable reactive material in varying molar ratios under suitable conditions of time, temperature and pressure comprising molar ratios varying from equimolar to more than molar to less than molar, at temperatures varying from about 50° to about 250° C., pressures varying from atmospheric to about 100 psi, for times varying from about an hour to about 48 hours thereby producing the desired ester additive product said product containing polymeric structures having ester functions and long-chain hydrocarbyl groups independently and regularly spaced along the polymer backbone.

9. The process of claim 8 wherein said reactive material is selected from the group consisting of epoxidized fatty esters, isocyanates, diisocyanates, epoxy halides, carbamates, diepoxides or dianhydrides.

10. The process of claim 8 wherein at least one of said monomers and optionally more than one, has a pendant hydrocarbyl group of at least $C_{12}$ or longer and wherein hydrocarbyl is selected from the group consisting of alkyl, alkenyl, aryl, alkaryl, aralkyl and optionally may be cyclic or polycylic.

11. The process of claim 8 wherein the product is post reacted with a suitable reagent.

12. The process of claim 8 wherein the monomers are phthalic anhydride, 1,2-epoxyoctadecane, and epoxidized methyl soyate.

13. The process of claim 8 wherein the monomers are phthalic anhydride, dipentaerythritol and 1,2-epoxyoctadecane.

14. The process of claim 8 wherein the additive products are prepared from monomers and/or reactive materials wherein said monomers or reactive materials are selected from the group consisting of 1,2-epoxyoctadecane, dipentaerythritol, pentaerythritol, tetrahydroxypropyl ethylenediamine, triethanolamine, 2-amino-2-ethyl-1,3-propanediol, epoxidized methyl soyate, epoxidized methyl linsedate, and phthalic anhydride.

15. The fuel additive concentrate of claim 14 whereby any sample of total volume of about 100 ml contains about 10 g of said additive dissolved therein.

16. The fuel additive concentrate of claim 14 wherein said solvent is selected from the group consisting of xylene, mixed xylenes and toluene.

17. A liquid hydrocarbyl fuel composition comprising a major amount of said fuel and a minor amount of a multifunctional low-temperature modifying distillate fuel polymeric and/or oligomeric ester additive product of reaction comprised of hydroxyl promoted polyester materials and ester promoted polyester materials prepared by polymerizing or oligomerizing a suitable combination of monomers selected from the group consisting of one or more long-chain epoxides or diol equivalents, one or more anhydrides or acid equivalents, and either (1) one or more epoxidized fatty ester, or (2) one or more co-reacted polyalcohols, and optionally a suitable reactive material in varying molar ratios under suitable conditions of time, temperature and pressure comprising molar ratios varying from equimolar to more than molar to less than molar, at temperatures varying from about 50° to about 250° C., pressures varying from atmospheric to about 100 psi, for times varying from about an hour to about 48 hours thereby producing the desired ester additive product said product containing polymeric structures having ester functions and long-chain hydrocarbyl groups independently and regularly spaced along the polymer backbone.

18. The fuel composition of claim 17 wherein a minor amount of from about 0.001 to about 10 wt % of a suitable distillate fuel pour point additive is added thereto.

19. The fuel composition of claim 17 wherein said reactive material is selected from the group consisting of isocyanates, diisocyanates, epoxy halides, carbamates, diepoxides or dianhydrides.

20. The fuel composition of claim 17 wherein at least one of said monomers and optionally more than one, has a pendant hydrocarbyl group of at least $C_{12}$ or longer and wherein hydrocarbyl is selected from the group consisting of alkyl, alkenyl, aryl, alkaryl, aralkyl and optionally may be cyclic or polycylic.

21. The fuel composition of claim 17 wherein the monomers and reactive material are respectively phthalic anhydride and 1,2-epoxyoctadecane, and epoxidized methyl soyate.

22. The fuel composition of claim 17 wherein the monomers and reactive material are respectively phthalic anhydride, dipentaerythritol and 1,2-epoxyoctadecane.

23. The fuel compositions of claim 18 wherein the additive products are prepared from monomers and/or reactive materials wherein said monomers or reactive materials are selected from the group consisting of 1,2-epoxyoctadecane, dipentaerythritol, pentaerythritol, tetrahydroxypropyl ethylenediamine, triethanolamine, 2-amino-2-ethyl-1,3-propanediol, epoxidized methyl soyate, epoxidized methyl linsedate, and phthalic anhydride.

* * * * *